US011839254B2

(12) United States Patent
Pomering

(10) Patent No.: US 11,839,254 B2
(45) Date of Patent: Dec. 12, 2023

(54) HELMET

(71) Applicant: MIPS AB, Täby (SE)

(72) Inventor: Amy Louise Pomering, Täby (SE)

(73) Assignee: MIPS AB

( * ) Notice: Subject to any disclaimer, the term of this patent is extended or adjusted under 35 U.S.C. 154(b) by 30 days.

(21) Appl. No.: 16/757,085

(22) PCT Filed: Oct. 9, 2018

(86) PCT No.: PCT/EP2018/077491
§ 371 (c)(1),
(2) Date: Apr. 17, 2020

(87) PCT Pub. No.: WO2019/076689
PCT Pub. Date: Apr. 25, 2019

(65) Prior Publication Data

US 2020/0260813 A1 Aug. 20, 2020

(30) Foreign Application Priority Data

Oct. 19, 2017 (GB) ..... 1717190
Jan. 5, 2018 (GB) ..... 1800186

(51) Int. Cl.
*A42B 3/06* (2006.01)

(52) U.S. Cl.
CPC ..... *A42B 3/06* (2013.01); *A42B 3/064* (2013.01)

(58) Field of Classification Search
CPC ..... A42B 3/06; A42B 3/064; A42B 3/127; A42B 3/125; A42B 3/10; A42B 3/12;
(Continued)

(56) References Cited

U.S. PATENT DOCUMENTS 7,003,803 B1 * 2/2006 Lyden ..... A42B 3/08 2/22
8,850,622 B2 10/2014 Finiel et al.
(Continued)

FOREIGN PATENT DOCUMENTS

CN 101227842 7/2008
CN 101861111 10/2010
(Continued)

OTHER PUBLICATIONS

International Search Report and Written Opinion dated May 17, 2017 for International Application No. PCT/EP2017/055591.

*Primary Examiner* — Jameson D Collier
*Assistant Examiner* — Matthew R Marchewka
(74) *Attorney, Agent, or Firm* — Perkins Coie LLP

(57) ABSTRACT

A helmet (1) comprises: an outer shell (2); an inner shell (3) lining an inner surface of the outer shell and formed from an energy absorbing material configured to protect against a radial component of an impact to the wearer's head; and a low friction sliding interface (4) between the inner shell and the outer shell configured to facilitate sliding of the inner shell relative to the outer shell in response to an impact to the wearer's head to protect against a tangential component of the impact; wherein the inner shell comprises a plurality of shell segments (30) each shell segment being configured to slide relative to the outer shell at the sliding interface and each shell segment being configured to move relative to each other shell segment.

20 Claims, 11 Drawing Sheets

(58) Field of Classification Search
CPC ..... A42B 3/147; A42B 3/04; A42B 3/0486; A42B 3/069; A63B 71/10; B32B 2437/04
USPC ..... 2/416, 414, 411, 412
See application file for complete search history.

(56) References Cited

U.S. PATENT DOCUMENTS

| | | | | |
|---|---|---|---|---|
| 2002/0007508 | A1* | 1/2002 | Grepper | A42B 3/324 2/420 |
| 2002/0023290 | A1* | 2/2002 | Watters | A42B 3/08 2/410 |
| 2005/0257312 | A1* | 11/2005 | Puchalski | A42B 3/324 2/411 |
| 2007/0157370 | A1 | 7/2007 | Joubert Des Ouches | |
| 2009/0260133 | A1 | 10/2009 | Del Rosario | |
| 2012/0047635 | A1 | 3/2012 | Finiel et al. | |
| 2013/0025032 | A1 | 1/2013 | Durocher et al. | |
| 2013/0031700 | A1 | 2/2013 | Wacter et al. | |
| 2013/0174329 | A1* | 7/2013 | Hanson | A42B 3/069 2/411 |
| 2014/0090154 | A1 | 4/2014 | Vito | |
| 2014/0090155 | A1 | 4/2014 | Johnston et al. | |
| 2015/0157083 | A1 | 6/2015 | Lowe | |
| 2016/0286885 | A1* | 10/2016 | Hyman | A42B 3/328 |
| 2017/0013907 | A1 | 1/2017 | Salmini et al. | |
| 2017/0049178 | A1 | 2/2017 | Durocher | |
| 2017/0188648 | A1 | 7/2017 | Larrabee | |
| 2019/0159542 | A1* | 5/2019 | Valentino, Sr. | A42B 3/064 |

FOREIGN PATENT DOCUMENTS

| | | |
|---|---|---|
| CN | 102406262 | 4/2012 |
| CN | 102811639 | 12/2012 |
| CN | 103635112 | 3/2014 |
| CN | 104936473 | 9/2015 |
| CN | 105636469 | 6/2016 |
| EP | 3117726 | 1/2017 |
| JP | 2014518337 A | 7/2014 |
| WO | WO 2001/045526 | 6/2001 |
| WO | WO 2011/139224 | 11/2011 |
| WO | WO 2015/089646 | 6/2015 |
| WO | 2016102225 A1 | 6/2016 |

* cited by examiner

HELMET

This application is a 371 national phase application of International Application No. PCT/EP2018/077491, filed Oct. 9, 2018, which claims priority to British Application No. 1800186.7, filed Jan. 5, 2018, and British Application No. 1717190.1, filed Oct. 19, 2017, the contents of each of which applications is incorporated herein by reference in its entirety.

The present invention relates to helmets. In particular, the invention relates to helmets with a plurality of internal shell segments that can slide with respect to each other and also with respect to an outer shell.

Helmets are known for use in various activities. These activities include combat and industrial purposes, such as protective helmets for soldiers and hard-hats or helmets used by builders, mine-workers, or operators of industrial machinery for example. Helmets are also common in sporting activities. For example, protective helmets may be used in ice hockey, cycling, motorcycling, motor-car racing, skiing, snow-boarding, skating, skateboarding, equestrian activities, American football, baseball, rugby, cricket, lacrosse, climbing, golf, airsoft and paintballing.

Helmets can be of fixed size or adjustable, to fit different sizes and shapes of head. In some types of helmet, e.g. commonly in ice-hockey helmets, the adjustability can be provided by moving parts of the helmet to change the outer and inner dimensions of the helmet. This can be achieved by having a helmet with two or more parts which can move with respect to each other. In other cases, e.g. commonly in cycling helmets, the helmet is provided with an attachment device for fixing the helmet to the user's head, and it is the attachment device that can vary in dimension to fit the user's head whilst the main body or shell of the helmet remains the same size. In some cases, comfort padding within the helmet can act as the attachment device. The attachment device can also be provided in the form of a plurality of physically separate parts, for example a plurality of comfort pads which are not interconnected with each other. Such attachment devices for seating the helmet on a user's head may be used together with additional strapping (such as a chin strap) to further secure the helmet in place. Combinations of these adjustment mechanisms are also possible.

Helmets are often made of an outer shell, that is usually hard and made of a plastic or a composite material, and an energy absorbing layer called a liner. Nowadays, a protective helmet has to be designed so as to satisfy certain legal requirements which relate to inter alia the maximum acceleration that may occur in the centre of gravity of the brain at a specified load. Typically, tests are performed, in which what is known as a dummy skull equipped with a helmet is subjected to a radial blow towards the head. This has resulted in modern helmets having good energy-absorption capacity in the case of blows radially against the skull. Progress has also been made (e.g. WO 2001/045526 and WO 2011/139224, which are both incorporated herein by reference, in their entireties) in developing helmets to lessen the energy transmitted from oblique blows (i.e. which combine both tangential and radial components), by absorbing or dissipating rotation energy and/or redirecting it into translational energy rather than rotational energy.

Such oblique impacts (in the absence of protection) result in both translational acceleration and angular acceleration of the brain. Angular acceleration causes the brain to rotate within the skull creating injuries on bodily elements connecting the brain to the skull and also to the brain itself.

Examples of rotational injuries include concussion, subdural haematomas (SDH), bleeding as a consequence of blood vessels rapturing, and diffuse axonal injuries (DAD, which can be summarized as nerve fibres being over stretched as a consequence of high shear deformations in the brain tissue.

Depending on the characteristics of the rotational force, such as the duration, amplitude and rate of increase, either SDH, DAI or a combination of these injuries can be suffered. Generally speaking, SDH occur in the case of accelerations of short duration and great amplitude, while DAI occur in the case of longer and more widespread acceleration loads.

Some prior art devices have sought to allow sliding within separate localised zones of a helmet, for handling impacts.

For example, US 2007/0157370 discloses a helmet with an outer shell split into segments, with an internal, continuous, foam liner. The out shell segments are joined to the liner so as to allow a slight sliding between the foam liner and at least a part of the shell segments. However this construction, splitting the outer shell into segments, potentially allows for the outer shell to be snagged on passing branches etc.

WO 2015/089646 discloses the use of internal pad members positioned at different locations within a helmet. The pad members may have layers that shear with respect to each other. However, the pad members are only present at discrete locations and do not provide a continuous liner within the helmet.

Similarly, US 2014/0090155 discloses a helmet in which an inner liner comprises one or more pads. In a particular embodiment, lateral pads at the side of the helmet can slide. However, other pads within the helmet do not slide.

US 2012/0047635 discloses a helmet with damping elements arranged within a liner. At least some of those damping elements can be attached to the surrounding shell by attaching means of the hook and loop type (i.e. VELCRO®). As such, this does not allow for any practical sliding between the shell and the damping elements in an impact situation.

As such, these segmented prior art devices do not provide ideal protection with respect to oblique impacts. The present invention aims to at least partially address this problem.

According to the invention, there is provided a helmet optionally comprising one or more of: an outer shell; an inner shell lining an inner surface of the outer shell and formed from an energy absorbing material configured to protect against a radial component of an impact to the wearer's head; and a low friction sliding interface between the inner shell and the outer shell configured to facilitate sliding of the inner shell relative to the outer shell in response to an impact to the wearer's head to protect against a tangential component of the impact; wherein the inner shell comprises a plurality of shell segments each shell segment being configured to slide relative to the outer shell at the sliding interface and each shell segment being configured to slide independently of each other shell segment. By providing the inner shell as a complete liner formed of segments, the entirety of the user's head is protected in the case of oblique impacts. Further, as individual segments can move, without being constrained by regions of the inner shell elsewhere in the helmet, it is possible to more reliably provide the protection against oblique impacts. That is, if for any reason the inner shell is prevented from sliding with respect to the outer shell in one area/segment, other areas/segments will still be able to slide, which may not be possible if the inner shell is provided as a single piece.

The at least two shell segments can be connected to each other by a connector configured to allow the two shell segments to slide independently of each other. In other words, the connector allows movement between the two shell segments, such that each can slide with respect to the outer shell without the other segment necessarily sliding with respect to the outer shell (or, at least, not necessarily sliding in the same direction). The connector can be arranged between the at least two shell segments. The connector can comprise a resilient structure.

The connector can be a separate component to the at least two shell segments. The connector can includes a layer of material connected at an inner or outer surface of the inner shell to the at least two shell segments and which spans a space between the at least two shell segments. The connector can be connected at an outer surface of the inner shell and covers the shell segments to form the low friction sliding interface with the outer shell.

The connector can be a part of the inner shell co-formed with the at least two shell segments between the at least two shell segments and formed so as to have a lower stiffness than the at least two shell segments so as to allow the at least two shell segments to move relative to each other. The connector can comprise apertures in the energy absorbing material forming the part of the inner shell configured to provide the lower stiffness of the connector compared to the at least two shell segments, wherein the energy absorbing material defining the apertures forms a resilient structure. The apertures can be circular in cross-section.

The aforementioned resilient structure can comprise at least one angular portion between the at least two shell segments, an angle of said angular portion being configured to change to allow relative movement between the at least two shell segments. Alternatively or additionally, the resilient structure can comprise at least one inflected portion between the at least two shell segments, an inflection amount of said angular portion being configured to change to allow relative movement between the at least two shell segments. Alternatively or additionally, the resilient structure can comprise at least one loop-like portion between the at least two shell segments, the shape of said loop-like portion being configured to change to allow relative movement between the at least two shell segments. Alternatively or additionally, the resilient structure can comprise at least two intersecting parts between the at least two shell segments, an angle at which said at least two intersecting parts intersect being configured to change to allow relative movement between the at least two shell segments. Alternatively or additionally, the resilient structure can comprise at least straight portion between the at least two shell segments, the straight portion being configured to bend to allow relative movement between the at least two shell segments.

The helmet can comprise front and rear shell segments arranged to cover front and rear parts of the wearer's head respectively. One of the front shell segment or rear shell segment can comprise a protruding portion configured to protrude into a cut-out portion of the other of the front shell segment and the rear shell segment. The protruding portion can be surrounded on opposing sides by lateral portions of the one of the front shell segment or rear shell segment comprising the protruding portion wherein the protruding portion and the lateral portions are separated by respective gaps in the one of the front shell segment or rear shell segment comprising the protruding portion. A distal edge of the protruding portion cam be arced or flat.

The front shell segment can be an elongate shell segment extending across the front of the helmet from side to side arranged to cover the wearer's forehead and the rear shell segment is arranged to cover rear, left and right portions of the wearer's head and optionally the crown of the wearer's head.

The helmet can comprise left and right side shell segments arranged to cover left and right sides the wearer's head respectively.

The helmet can comprise a central shell segment arranged to cover the crown of the wearer's head. One of the front shell segment and the rear shell segment can surround the central shell segment. The central shell segment can be oval.

Adjacent shell segments can have a complementary shape.

In some arrangements, at least two adjacent shell segments may not be connected to each other. The at least two adjacent shell segments can be arranged so as to be separated by a distance less than a limit of relative movement between the adjacent shell segments.

The plurality of shell segments can be arranged such that a separation between adjacent shell segments is smaller than the shell segments. The plurality of shell segments can be arranged such that a separation between adjacent shell segments is smaller than the thickness of the shell segments.

At least one shell segment can be connected to the outer shell by a shell connector, the shell connector being configured to allow sliding between the inner and outer shells. At least one shell connector can be provided for each shell segment. The shell connectors can be configured to maintain the connection between the inner shell segments and the outer shall during relative sliding in response to an impact.

The invention is described below by way of non-limiting examples, with reference to the accompanying drawings, in which.

Figure 8A:
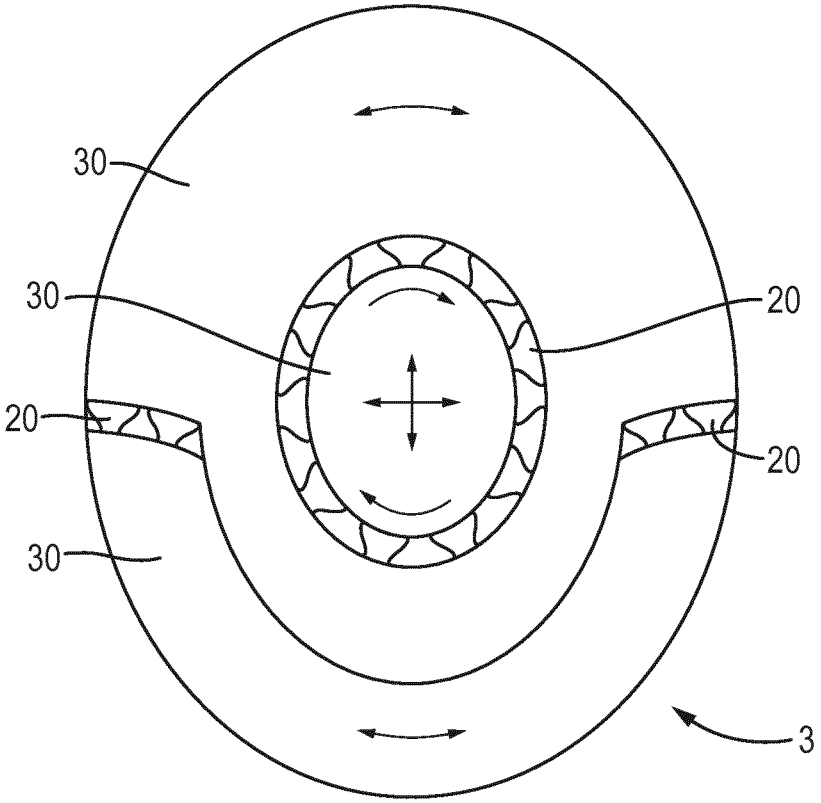
Figure 8B:
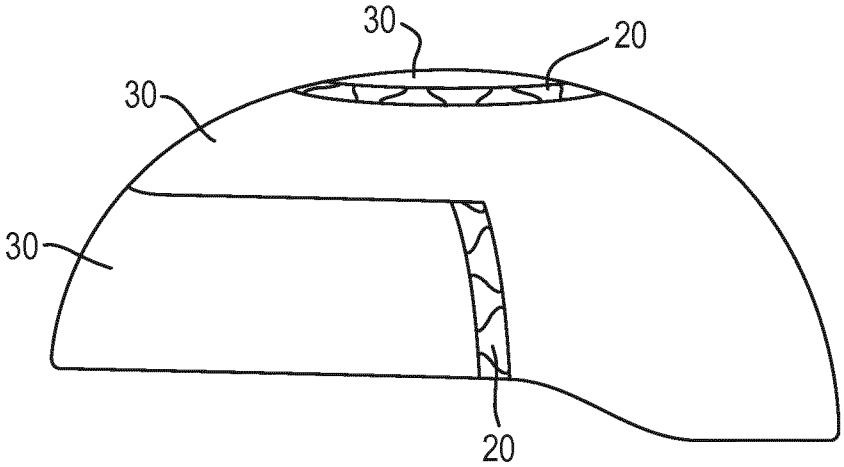

FIG. 8*a* is a schematic drawing showing a top view of an alternative inner shell, formed of segments, for a helmet; and FIG. 8*b* is a schematic drawing showing a side view of the inner shell of FIG. 8*a;*

Figure 9:
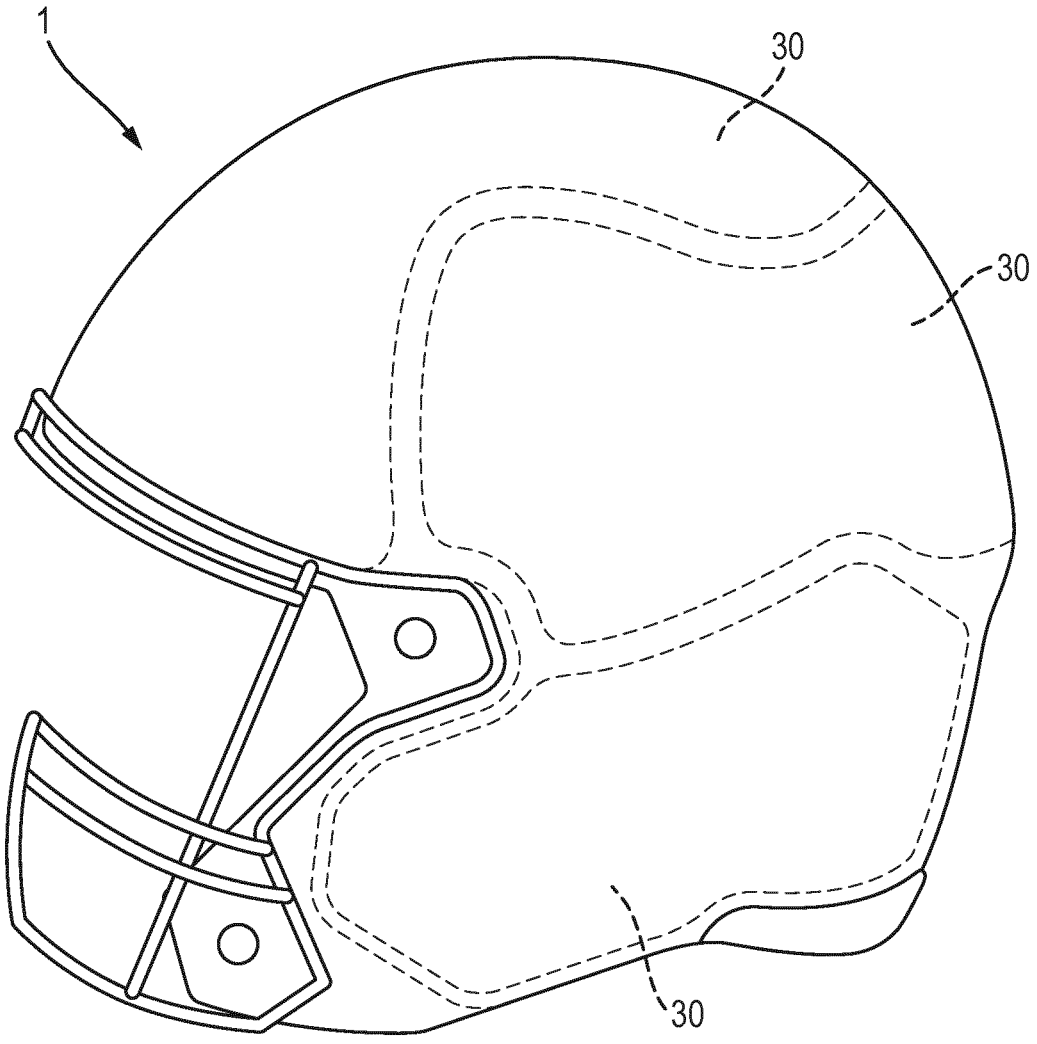
Figure 10A:
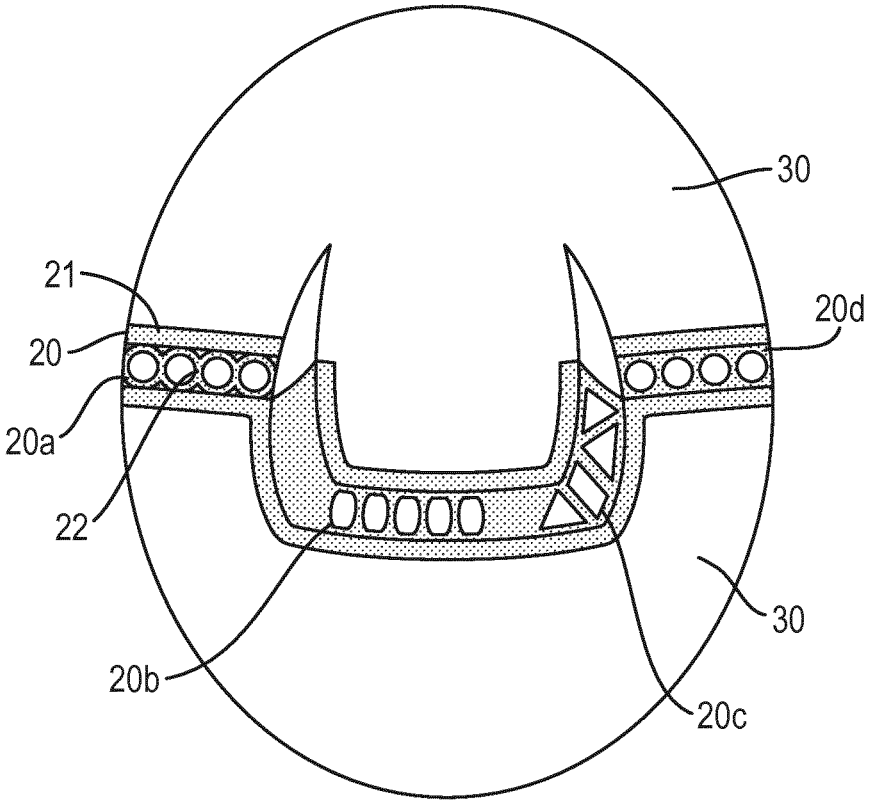
Figure 10B:
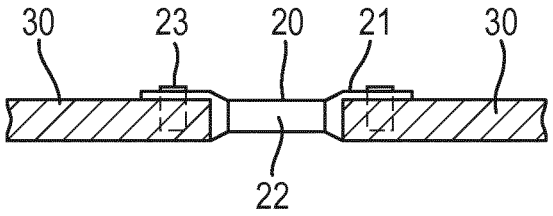

FIG. 9 is a schematic drawing showing a side view of a helmet having an inner shell formed of segments;

FIG. 10*a* is a schematic drawing showing a bottom view of an alternative inner shell for a helmet, showing detail of the connectors between segments; and FIG. 10*b* shows a cross-sectional view through one of the connectors used in the inner shell of FIG. 10*a;*

Figure 11A:
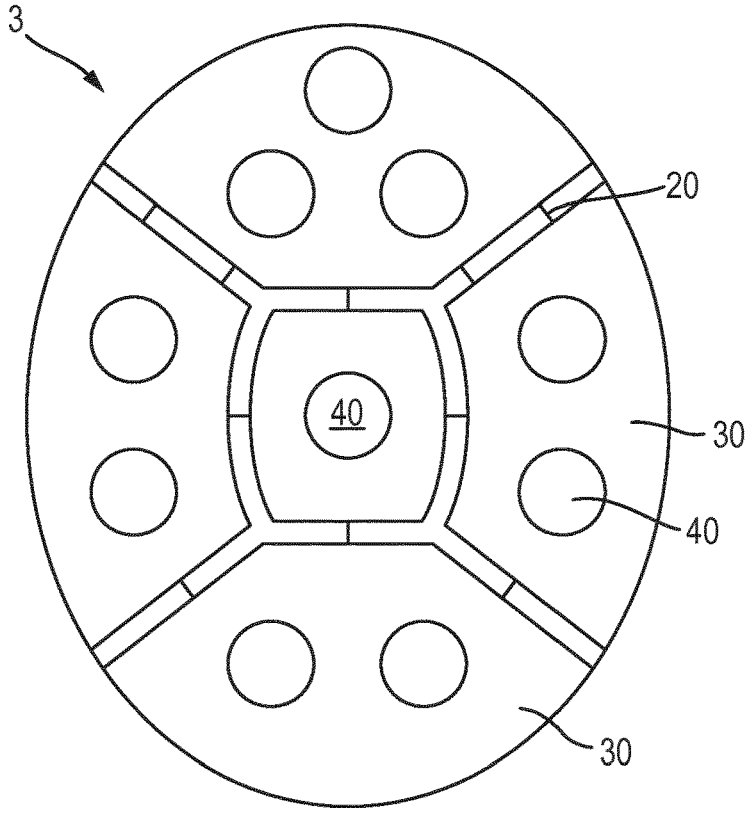
Figure 11B:
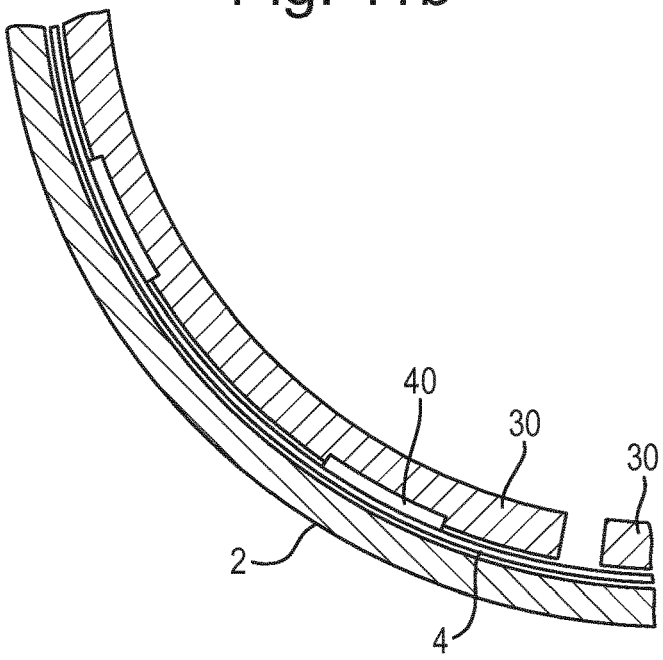

FIG. 11*a* is a schematic drawing showing a top view of an alternative inner shell for a helmet, showing attachments points on the different segments; and FIG. 11*b* shows a cross-sectional view through a helmet comprising the inner shell of FIG. 11*a;*

Figure 12:
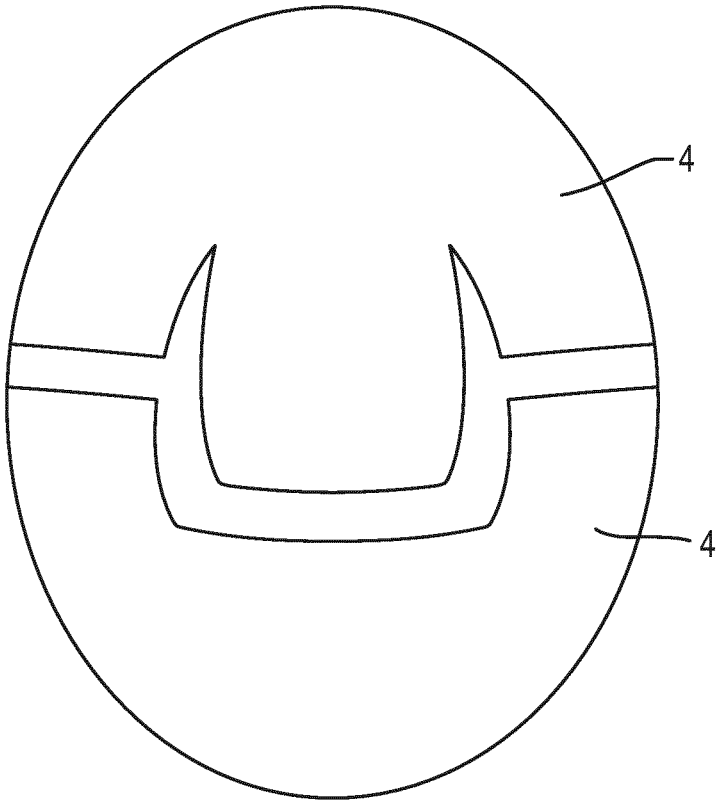
Figure 13:
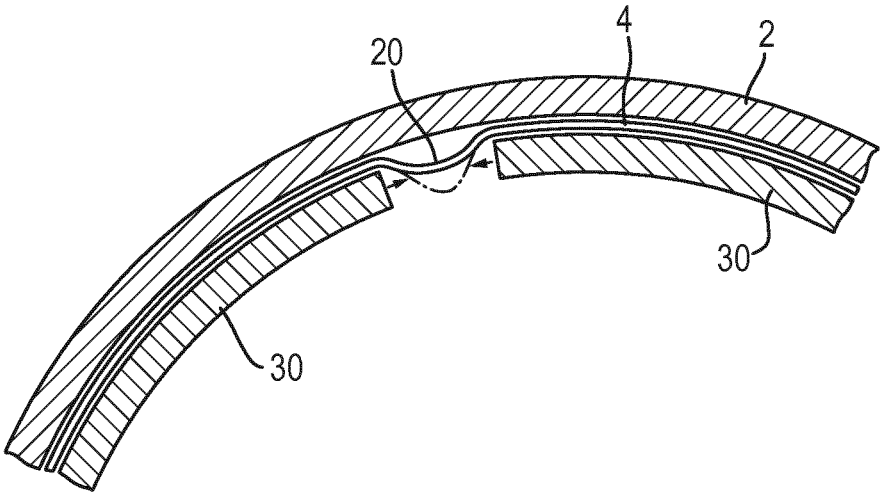
Figure 14:
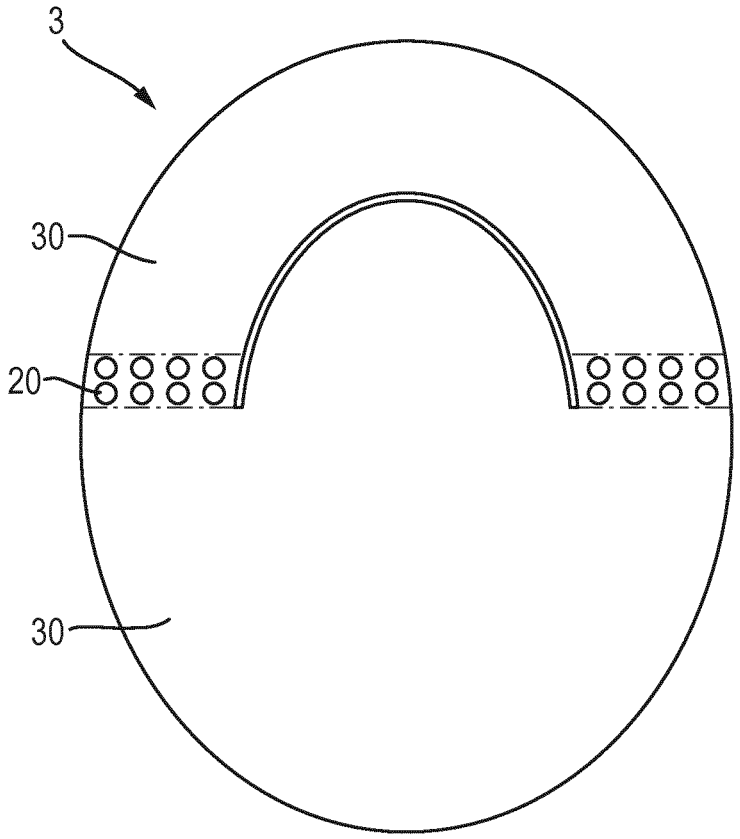
Figure 15:
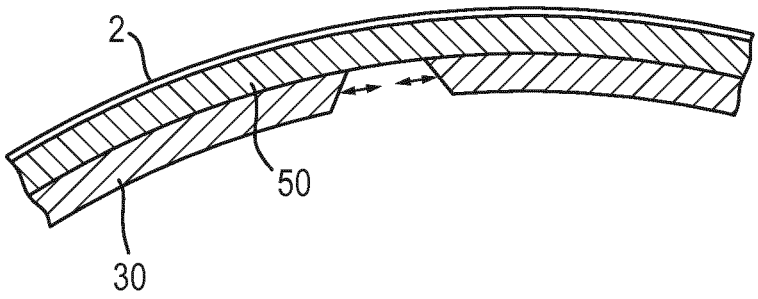
Figure 16:
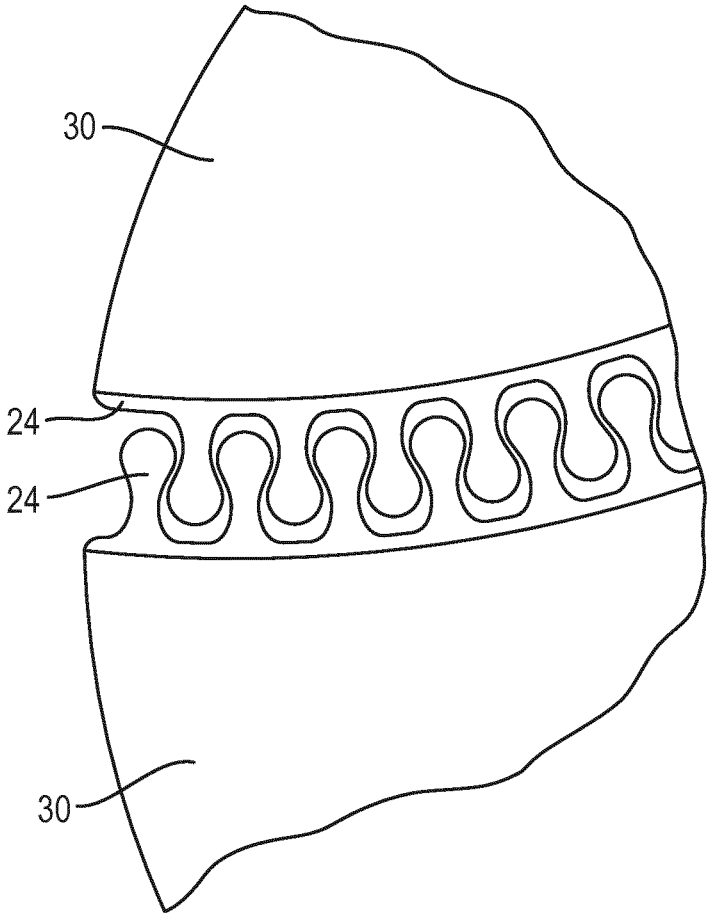
Figure 17:
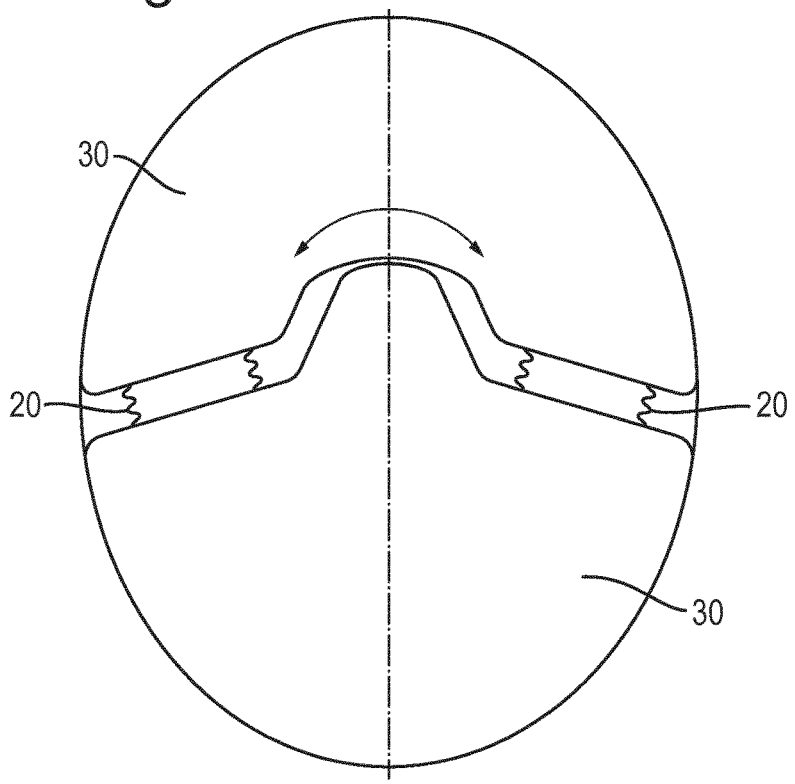
Figure 18:
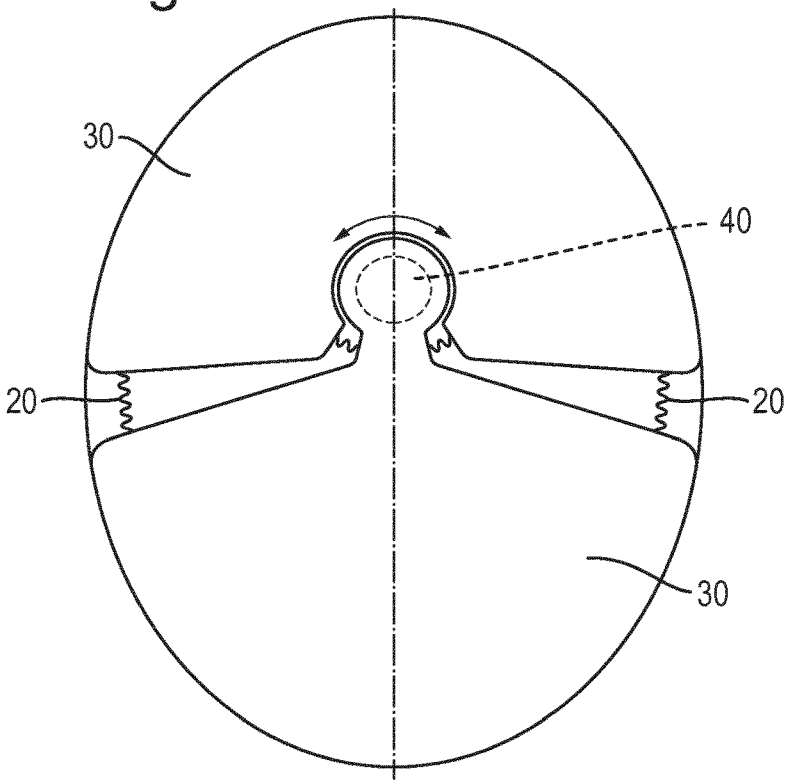

FIG. 12 is a schematic drawing showing a low friction sliding layer for use in a helmet having a segmented inner shell;

FIG. 13 is a schematic drawing showing a cross sectional view of a helmet in which a low friction layer acts as a connector between segments of the inner shell;

FIG. 14 is a schematic drawing showing a top view of an alternative inner shell for a helmet, in which connectors between the segments are co-formed with the segments;

FIG. 15 is a schematic drawing showing a cross sectional view of a helmet having two inner shells;

FIG. 16 is a schematic drawing showing a view of two segments having interlocking connector pieces;

FIG. 17 is a schematic drawing showing a plan view of an inner shell of a helmet having segments that can both translate and rotate with respect to each other; and FIG. 18 is a schematic drawing showing a plan view of an alternative inner shell of a helmet having segments that can rotate with respect to each other.

The proportions of the thicknesses of the various layers in the helmets depicted in the figures have been exaggerated in the drawings for the sake of clarity and can of course be adapted according to need and requirements.

Figure 1:
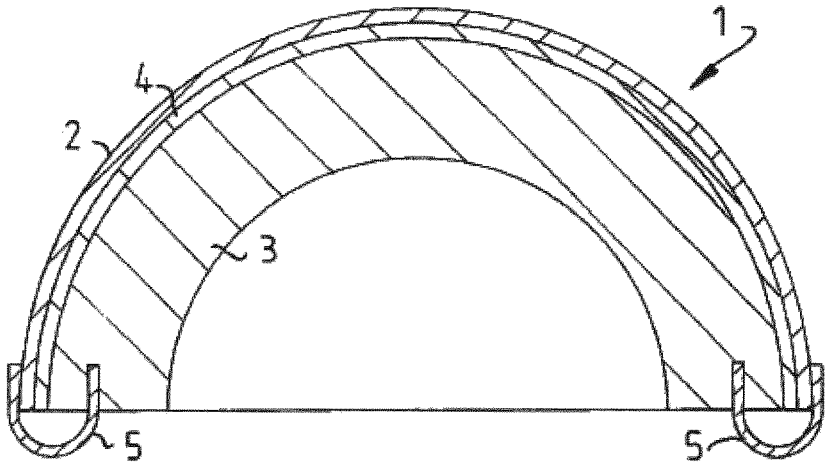
FIG. 1 depicts a cross section through a helmet for providing protection against oblique impacts.

FIG. 1 depicts a first helmet 1 of the sort discussed in WO 01/45526, intended for providing protection against oblique impacts. This type of helmet could be any of the types of helmet discussed above.

Protective helmet 1 is constructed with an outer shell 2 and, arranged inside the outer shell 2, an inner shell 3 that is intended for contact with the head of the wearer.

Arranged between the outer shell 2 and the inner shell 3 is a sliding layer or a sliding facilitator 4, and this makes relative displacement possible between the outer shell 2 and the inner shell 3. In particular, as discussed below, a sliding layer 4 or sliding facilitator may be configured such that sliding may occur between two parts during an impact. For example, it may be configured to enable sliding under forces associated with an impact on the helmet 1 that is expected to be survivable for the wearer of the helmet 1. In some arrangements, it may be desirable to configure the sliding layer or sliding facilitator such that the coefficient of friction is between 0.001 and 0.3 and/or below 0.15.

Arranged in the edge portion of the helmet 1, in the FIG. 1 depiction, may be one or more connecting members 5 which interconnect the outer shell 2 and the inner shell 3. In some arrangements, the connectors may counteract mutual displacement between the outer shell 2 and the inner shell 3 by absorbing energy. However, this is not essential. Further, even where this feature is present, the amount of energy absorbed is usually minimal in comparison to the energy absorbed by the inner shell 3 during an impact. In other arrangements, connecting members 5 may not be present at all.

Further, the location of these connecting members 5 can be varied (for example, being positioned away from the edge portion, and connecting the outer shell 2 and the inner shell 3 through the sliding layer 4).

The outer shell 2 is preferably relatively thin and strong so as to withstand impact of various types. The outer shell 2 could be made of a polymer material such as polycarbonate (PC), polyvinylchloride (PVC) or acrylonitrile butadiene styrene (ABS) for example. Advantageously, the polymer material can be fibre-reinforced, using materials such as glass-fibre, Aramid, TWARON®, carbon-fibre or KEVLAR®.

The inner shell 3 is considerably thicker and acts as an energy absorbing layer. As such, it is capable of damping or absorbing impacts against the head. It can advantageously be made of foam material like expanded polystyrene (EPS), expanded polypropylene (EPP), expanded polyurethane (EPU), vinyl nitrile foam; or other materials forming a honeycomb-like structure, for example; or strain rate sensitive foams such as marketed under the brand-names PORON™ and D3O™. The construction can be varied in different ways, which emerge below, with, for example, a number of layers of different materials.

Inner shell 3 is designed for absorbing the energy of an impact. Other elements of the helmet 1 will absorb that energy to a limited extend (e.g. the hard outer shell 2 or so-called 'comfort padding' provided within the inner shell 3), but that is not their primary purpose and their contribution to the energy absorption is minimal compared to the energy absorption of the inner shell 3. Indeed, although some other elements such as comfort padding may be made of 'compressible' materials, and as such considered as 'energy absorbing' in other contexts, it is well recognised in the field of helmets that compressible materials are not necessarily 'energy absorbing' in the sense of absorbing a meaningful amount of energy during an impact, for the purposes of reducing the harm to the wearer of the helmet.

A number of different materials and embodiments can be used as the sliding layer 4 or sliding facilitator, for example oil, TEFLON' (polytetrafluoroethylene (PTFE)), microspheres, air, rubber, polycarbonate (PC), a fabric material such as felt, etc. Such a layer may have a thickness of roughly 0.1-5 mm, but other thicknesses can also be used, depending on the material selected and the performance desired. The number of sliding layers and their positioning can also be varied, and an example of this is discussed below (with reference to FIG. 3B).

As connecting members 5, use can be made of, for example, deformable strips of plastic or metal which are anchored in the outer shell and the inner shell in a suitable manner.

Figure 2:
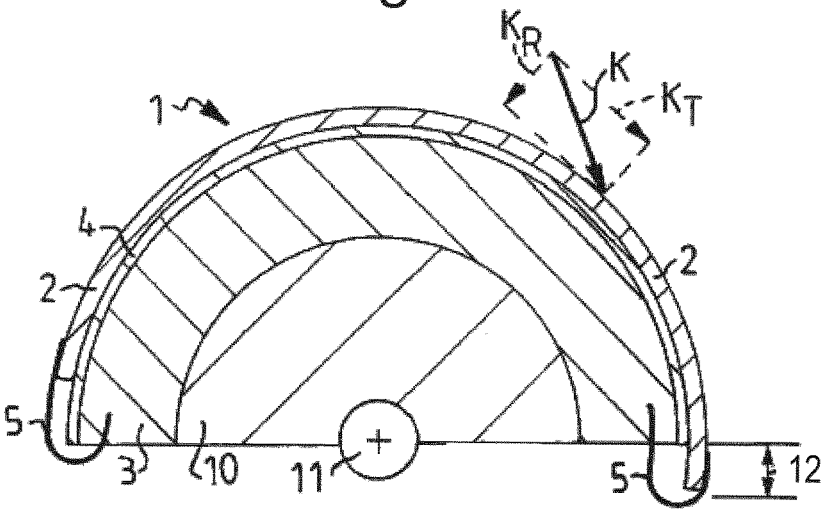
FIG. 2 is a diagram showing the functioning principle of the helmet of FIG. 1.

FIG. 2 shows the functioning principle of protective helmet 1, in which the helmet 1 and a skull 10 of a wearer are assumed to be semi-cylindrical, with the skull 10 being mounted on a longitudinal axis 11. Torsional force and torque are transmitted to the skull 10 when the helmet 1 is subjected to an oblique impact K. The impact force K gives rise to both a tangential force $K_T$ and a radial force $K_R$ against the protective helmet 1. In this particular context, only the helmet-rotating tangential force $K_T$ and its effect are of interest.

As can be seen, the force K gives rise to a displacement 12 of the outer shell 2 relative to the inner shell 3, the connecting members 5 being deformed. A reduction in the torsional force transmitted to the skull 10 of roughly 25% can be obtained with such an arrangement. This is a result of the sliding motion between the inner shell 3 and the outer shell 2 reducing the amount of energy which is transferred into radial acceleration.

Sliding motion can also occur in the circumferential direction of the protective helmet 1, although this is not depicted. This can be as a consequence of circumferential angular rotation between the outer shell 2 and the inner shell 3 (i.e. during an impact the outer shell 2 can be rotated by a circumferential angle relative to the inner shell 3).

Figure 3A:
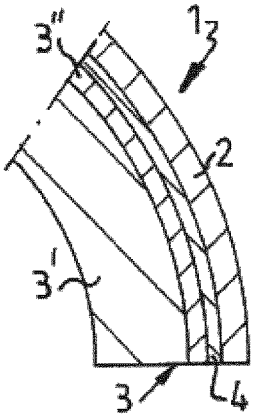
FIGS. 3A, 3B & 3C show variations of the structure of the helmet of FIG. 1.
Figure 3B:
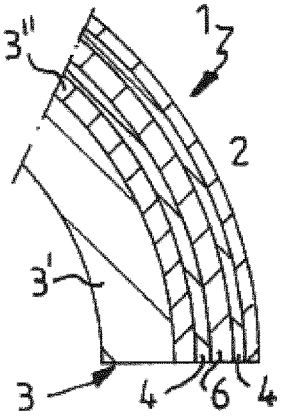
Figure 3C:
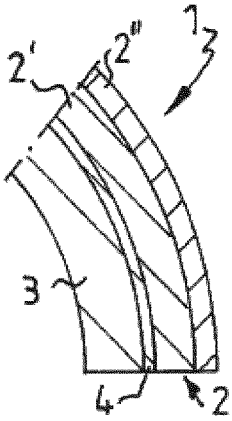

Other arrangements of the protective helmet 1 are also possible. A few possible variants are shown in FIG. 3. In FIG. 3*a*, the inner shell 3 is constructed from a relatively thin outer layer 3" and a relatively thick inner layer 3'. The outer layer 3" is preferably harder than the inner layer 3', to help facilitate the sliding with respect to outer shell 2. In FIG. 3*b*, the inner shell 3 is constructed in the same manner as in FIG. 3*a*. In this case, however, there are two sliding layers 4, between which there is an intermediate shell 6. The two sliding layers 4 can, if so desired, be embodied differently and made of different materials. One possibility, for example, is to have lower friction in the outer sliding layer than in the inner. In FIG. 3*c*, the outer shell 2 is embodied differently to previously. In this case, a harder outer layer 2" covers a softer inner layer 2'. The inner layer 2' may, for example, be the same material as the inner shell 3.

Figure 4:
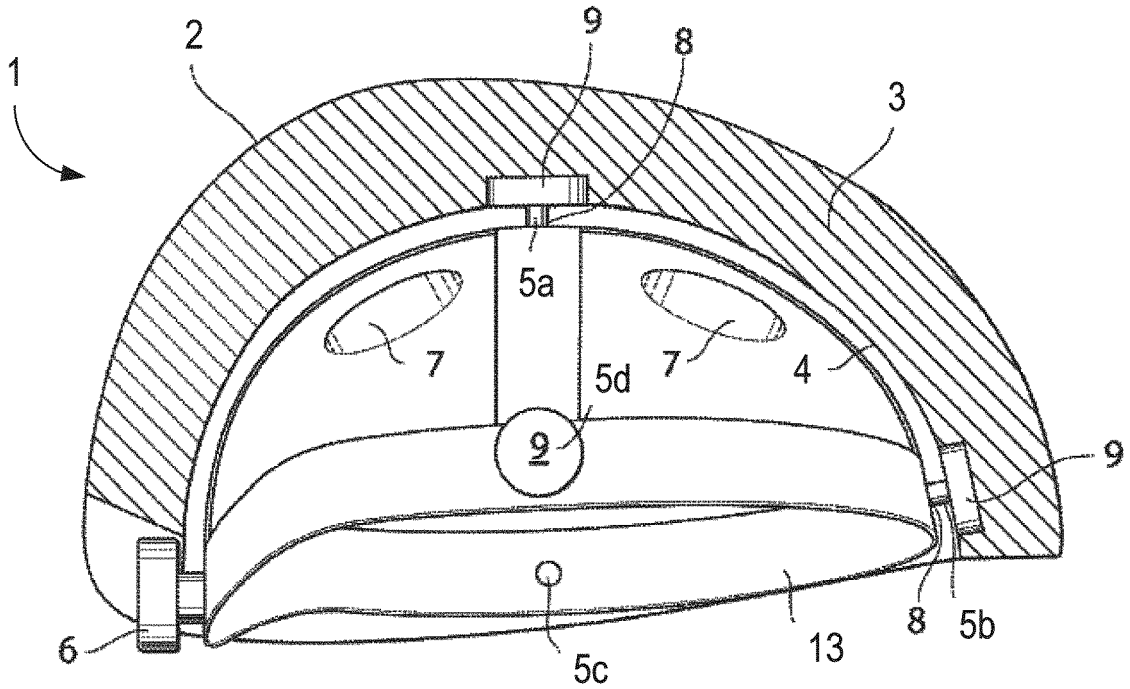
FIG. 4 is a schematic drawing of a another protective helmet.

FIG. 4 depicts a second helmet 1 of the sort discussed in WO 2011/139224, which is also intended for providing protection against oblique impacts. This type of helmet could also be any of the types of helmet discussed above.

In FIG. 4, helmet 1 comprises an energy absorbing layer 3, similar to the inner shell 3 of the helmet of FIG. 1. The outer surface of the energy absorbing layer 3 may be provided from the same material as the energy absorbing layer 3 (i.e. there may be no additional outer shell), or the outer surface could be a rigid shell 2 (see FIG. 5) equivalent to the outer shell 2 of the helmet shown in FIG. 1. In that case, the rigid shell 2 may be made from a different material than the energy absorbing layer 3. The helmet 1 of FIG. 4 has a plurality of vents 7, which are optional, extending through both the energy absorbing layer 3 and the outer shell 2, thereby allowing airflow through the helmet 1.

An attachment device 13 is provided, for attachment of the helmet 1 to a wearer's head. As previously discussed, this may be desirable when energy absorbing layer 3 and rigid shell 2 cannot be adjusted in size, as it allows for the different size heads to be accommodated by adjusting the size of the attachment device 13. The attachment device 13 could be made of an elastic or semi-elastic polymer material, such as PC, ABS, PVC or PTFE, or a natural fibre material such as cotton cloth. For example, a cap of textile or a net could form the attachment device 13.

Although the attachment device 13 is shown as comprising a headband portion with further strap portions extending from the front, back, left and right sides, the particular configuration of the attachment device 13 can vary according to the configuration of the helmet. In some cases the attachment device may be more like a continuous (shaped) sheet, perhaps with holes or gaps, e.g. corresponding to the positions of vents 7, to allow air-flow through the helmet.

FIG. 4 also depicts an optional adjustment device 6 for adjusting the diameter of the head band of the attachment device 13 for the particular wearer. In other arrangements, the head band could be an elastic head band in which case the adjustment device 6 could be excluded.

A sliding facilitator 4 is provided radially inwards of the energy absorbing layer 3. The sliding facilitator 4 is adapted to slide against the energy absorbing layer or against the attachment device 13 that is provided for attaching the helmet to a wearer's head.

The sliding facilitator 4 is provided to assist sliding of the energy absorbing layer 3 in relation to an attachment device 13, in the same manner as discussed above. The sliding facilitator 4 may be a material having a low coefficient of friction, or may be coated with such a material.

As such, in the FIG. 4 helmet, the sliding facilitator may be provided on or integrated with the innermost sided of the energy absorbing layer 3, facing the attachment device 13.

However, it is equally conceivable that the sliding facilitator 4 may be provided on or integrated with the outer surface of the attachment device 13, for the same purpose of providing slidability between the energy absorbing layer 3 and the attachment device 13. That is, in particular arrangements, the attachment device 13 itself can be adapted to act as a sliding facilitator 4 and may comprise a low friction material.

In other words, the sliding facilitator 4 is provided radially inwards of the energy absorbing layer 3. The sliding facilitator can also be provided radially outwards of the attachment device 13.

When the attachment device 13 is formed as a cap or net (as discussed above), sliding facilitators 4 may be provided as patches of low friction material.

The low friction material may be a waxy polymer, such as PTFE, acrylonitrile butadiene styrene (ABS), polyvinyl chloride (PVC), polycarbonate (PC), Nylon, perfluoroalkoxy alkane (PFA), fluorinated ethylene propylene (FEP), polyethylene (PE) and ultra-high-molecular-weight polyethylene (UHMWPE), or a powder material which could be infused with a lubricant. The low friction material could be a fabric material. As discussed, this low friction material could be applied to either one, or both of the sliding facilitator and the energy absorbing layer The attachment device 13 can be fixed to the energy absorbing layer 3 and/or the outer shell 2 by means of fixing members 5, such as the four fixing members 5*a*, 5*b*, 5*c* and 5*d* in FIG. 4. These may be adapted to absorb energy by deforming in an elastic, semi-elastic or plastic way. However, this is not essential. Further, even where this feature is present, the amount of energy absorbed is usually minimal in comparison to the energy absorbed by the energy absorbing layer 3 during an impact.

According to the embodiment shown in FIG. 4 the four fixing members 5*a*, 5*b*, 5*c* and 5*d* are suspension members 5*a*, 5*b*, 5*c*, 5*d*, having first and second portions 8, 9, wherein the first portions 8 of the suspension members 5*a*, 5*b*, 5*c*, 5*d* are adapted to be fixed to the attachment device 13, and the second portions 9 of the suspension members 5*a*, 5*b*, 5*c*, 5*d* are adapted to be fixed to the energy absorbing layer 3.

Figure 5:
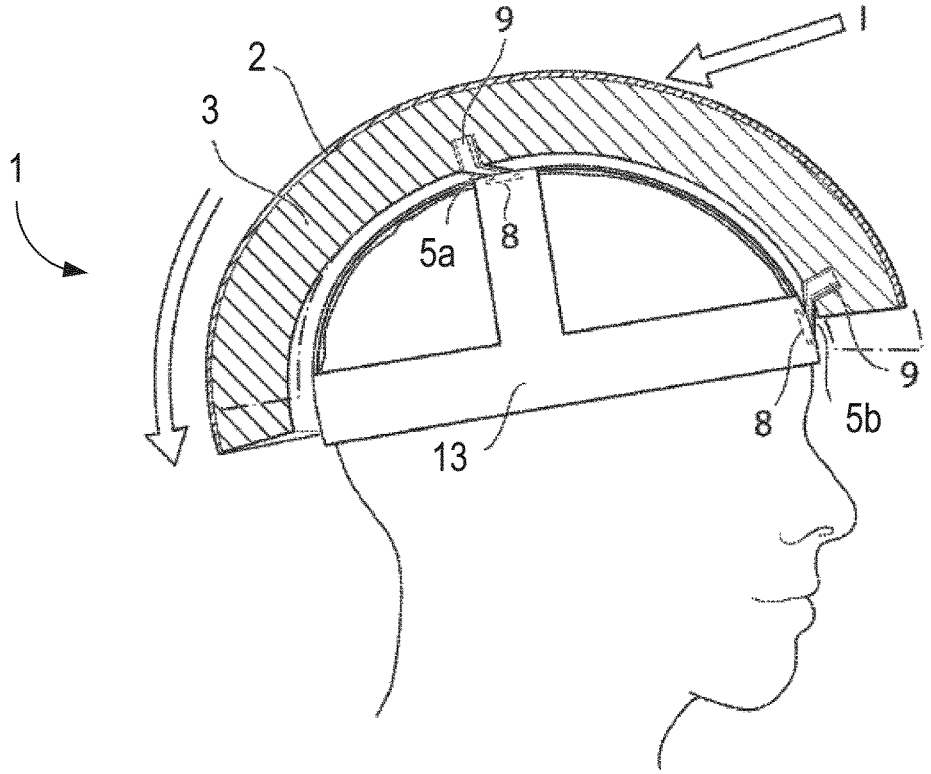
FIG. 5 depicts an alternative way of connecting the attachment device of the helmet of FIG. 4.

FIG. 5 shows an embodiment of a helmet similar to the helmet in FIG. 4, when placed on a wearers' head. The helmet 1 of FIG. 5 comprises a hard outer shell 2 made from a different material than the energy absorbing layer 3. In contrast to FIG. 4, in FIG. 5 the attachment device 13 is fixed to the energy absorbing layer 3 by means of two fixing members 5*a*, 5*b*, which are adapted to absorb energy and forces elastically, semi-elastically or plastically.

A frontal oblique impact I creating a rotational force to the helmet is shown in FIG. 5. The oblique impact I causes the energy absorbing layer 3 to slide in relation to the attachment device 13. The attachment device 13 is fixed to the energy absorbing layer 3 by means of the fixing members 5*a*, 5*b*. Although only two such fixing members are shown, for the sake of clarity, in practice many such fixing members may be present. The fixing members 5 can absorb the rotational forces by deforming elastically or semi-elastically. In other arrangements, the deformation may be plastic, even resulting in the severing of one or more of the fixing members 5. In the case of plastic deformation, at least the fixing members 5 will need to be replaced after an impact. In some cases a combination of plastic and elastic deformation in the fixing members 5 may occur, i.e. some fixing members 5 rupture, absorbing energy plastically, whilst other fixing members deform and absorb forces elastically.

In general, in the helmets of FIG. 4 and FIG. 5, during an impact the energy absorbing layer 3 acts as an impact absorber by compressing, in the same way as the inner shell of the FIG. 1 helmet. If an outer shell 2 is used, it will help spread out the impact energy over the energy absorbing layer 3. The sliding facilitator 4 will also allow sliding between the attachment device and the energy absorbing layer. This allows for a controlled way to dissipate energy that would otherwise be transmitted as rotational energy to the brain.

The energy can be dissipated by friction heat, energy absorbing layer deformation or deformation or displacement of the fixing members. The reduced energy transmission results in reduced rotational acceleration affecting the brain, thus reducing the rotation of the brain within the skull. The risk of rotational injuries such as subdural haematomas, SDH, blood vessel rapturing, concussions and DAI is thereby reduced.

FIGS. 1-5, described above, depict helmets 1 in which the inner shell/energy absorbing layer 3 is constructed from a single piece. However, according to the present disclosure, helmets 1 having the features depicted in, and described with reference to, FIGS. 1-5 may also have a split inner shell 3 as described further below.

Figure 6:
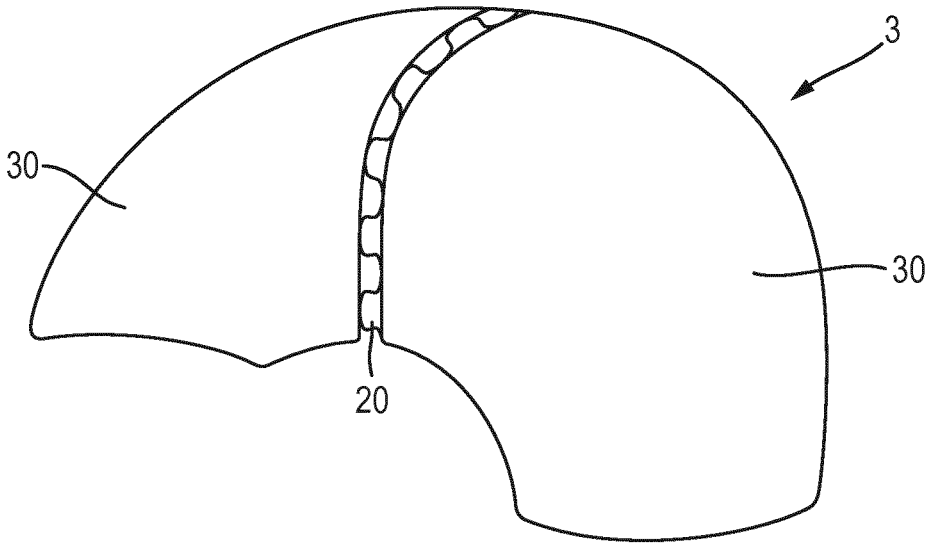
FIG. 6 is a schematic drawing showing a side view of an inner shell, formed of segments, for a helmet.

FIG. 6 shows a side view of an inner shell 3 that may be incorporated into a helmet 1 such as depicted in FIGS. 1-5. The inner shell 3 can completely line the inner surface of an outer shell 2. As described above, the inner shell 3 is formed from an energy absorbing material configured to protect against a radial component of an impact to the wearer's head.

As shown in FIG. 6, inner shell 3 comprises a plurality of shell segments 30. The shell segments 30 can be connected by means of one or more connectors 20, discussed in more detail below.

Each shell segment 30 is configured to slide relative to the outer shell 2. This can be achieved by providing a low friction sliding interface 4 between the inner shell 3 and the outer shell 2, as discussed above. The low friction sliding interface 4 is configured to facilitate sliding of the inner shell segments 30 relative to the outer shell 2 in response to an impact to the wearer's head, to protect against a tangential component of the impact.

Further, each shell segment 30 is configured to slide independently of each other shell segment. In other words, each segment 30 can move relative to each other shell segment 30 such that each segment 30 can slide with respect to the outer shell 2 without the other segments 30 necessarily sliding with respect to the outer shell 2 (or, at least, not necessarily sliding in the same direction). That is, all segments 30 of the inner shell 3 are configured to provide movement relative to each other and to the outer shell. As a result, the inner surface of the outer shell 2 is lined by the mobile shell segments 30 and the connectors 20 therebetween. In some implementations at least 80% of the inner surface of the outer shell 2 is lined by the mobile shell segments 30, optionally at 90% of the inner surface of the outer shell 2 is lined by the mobile shell segments 30, and further optionally at least 95% of the inner surface of the outer shell 2 is lined by the mobile shell segments 30.

The shell segments 30 can be arranged so that adjacent shell segments are separated by a distance less than a limit of relative movement between the adjacent shell segments 30. In other words, the shell segments 30 can be positioned close enough to each other that they can touch or even overlap when they move. In some arrangements, the separation between the shell segments 30 can be smaller than the thickness of the shell segments 30.

In some implementations, the inner surface of the outer shell can be formed as a spherical surface, and the outer surface of the inner shell segments 30 can be formed as sections of a sphere. The spherical surface of the inner shell segments 30 can be of the corresponding size to the spherical surface of the outer shell, or may be different (i.e. a sphere with the substantially the same radius, or of slightly smaller radius, as the spherical radius of the inner surface of the outer shell). This arrangement can allow the inner shell segments 30 to slide with respect to the outer shell without risk of geometric locking (i.e. without the shapes of the different surfaces preventing sliding). However, this arrangement is not necessary, and sufficient mobility can be obtained with non-spherical arrangements. Further, even if the sliding surfaces between the outer shell and the inner shell segments 30 are spherical, neither the outer surface of the outer shell, nor the inner surface of the shell segments 30 needs to also be spherical. Instead, those surfaces may take another shape (e.g. so the inner surface of the shell segments 30 can be shaped to the user's head, for example).

As mentioned above, one or more connectors 20 can be provided, so that at least two shell segments are connected to each other by a connector 20. The connector 20 is configured to allow the two shell segments to each slide independently with respect to the outer shell, by allowing relative movement between the two shell segments 30. The connectors 20 connect the shell segments 30 but do not attach to the outer shell 2.

The connector 20 can be a separate component to the at least two shell segments, as shown in FIG. 6. Alternatively, the connector can be formed with the shell segments 30, as discussed in further detail below.

The connector 20 is arranged between the two shell segments 30 in FIG. 6. The connector 20 is formed as a resilient structure, which can be deformed to allow the motion of the shell segments 30 with respect to each other and the surrounding outer shell 2.

FIG. 6 shows an example of an inner shell 3 which comprises front and rear shell segments 30, which are arranged to cover front and rear parts of the wearer's head respectively. The front segment 30 is an elongate shell segment extending across the front of the helmet from side to side arranged to cover the wearer's forehead. The rear shell segment 30 is arranged, in this example, to cover rear, left and right portions of the wearer's head and also the crown of the wearer's head. In other alternatives, the front shells segment 30 could extend to the cover the crown of the wearer's head instead of the back shell segment 30. In either case, the shell segments 30 can have a complementary shape so that they substantially entirely line the inner surface of the outer shell 2.

Figure 7:
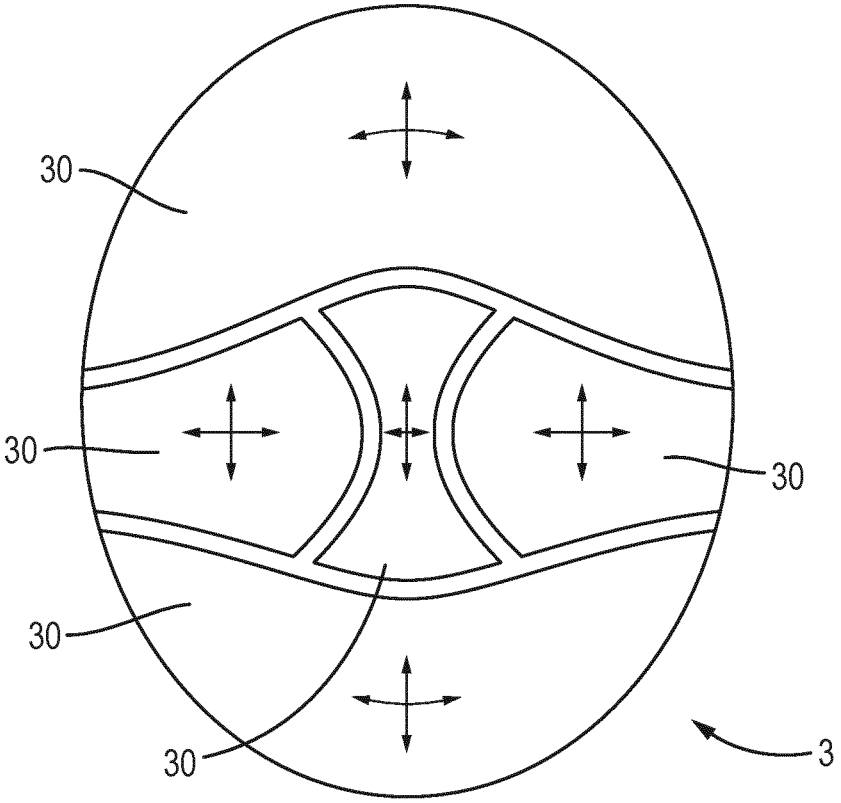
FIG. 7 is a schematic drawing showing a top view of an alternative inner shell, formed of segments, for a helmet.

FIG. 7 shows a top view of an alternative arrangement, in which the inner shell 3 incorporates further shell segments 30 (N.B in FIG. 7, the connectors 20 are not explicitly shown). In the arrangement of FIG. 7, there are provided additional lateral, i.e. left and right, segments 30 arranged to cover left and right sides of the wearers head respectively. There is also central shell segment 30 arranged to sit at the top of the wearer's head in use (i.e. a segment arranged to cover the wearer's crown).

FIG. 7 also includes arrows on each of the segments 30, indicating that the segments 30 can move in all directions with respect to each other FIGS. 8A and B illustrate an alternative arrangement in which the movement of some segments 30 is comparatively constrained. FIG. 8A shows a bottom view of the arrangement, whilst FIG. 8B shows a side view of the arrangement. This arrangement comprises front and rear shell segments 30, similar to those in FIG. 6. In addition there is a central shell segment 30 arranged to cover the crown of the wearer's head. In this example the central segment 30 is approximately oval. The central segment 30 is not connected to the front segment 30.

The rear segment 30 surrounds the central segment 30. These two segments are connected by a connector 20 extending around the periphery of the central segment 30. As such, the central segment 30 is able to move in all directions with respect to the rear segment 30. However, the front segment 30 is only configured to move horizontally (as depicted in FIG. 8B), so as to move left and right around a wearer's head. In other words, this segment 30 does not move up and down, in use, with respect to the user's eyes. To implement this, connectors 20 are provided at the left and right ends of the front segment 30, but there is no connector between the front and rear segments. Instead, a sliding interface is provided between the front and rear segments.

It is noted that although the front segment of FIGS. 8A and 8B may be relatively constrained in the directions in which it can slide with respect to the outer shell 2, it can nonetheless move independently with respect to each of the other segments 30. Moreover, the front segment is still able to slide relative to the outer shell, although the directions available for sliding are not constrained in the same way as the motion relative to the other shell segments (i.e. because the entire inner shell 3 can slide back to front, for example).

FIGS. 17 and 18 show two further arrangements. In these arrangements the movement of some segments 30 is comparatively constrained. Nonetheless, the segments 30 can still slide with respect to an outer shell 2 independently of each other. In FIG. 17 the front and rear segments 30 abut along the centreline of the helmet. However, the two segments 30 are able to slide and pivot around that abutment. In other words the two segments 30 can both translate and rotate with respect to each other, and can slide with respect to the outer shell 2. However, the point of abutment puts some limits on the types of movement possible. Similarly, in FIG. 18 the rear segment 30 has a portion projecting into a void in the front segment 30. The two segments are effectively joined in a 'jigsaw' manner, with the projection from the rear segment forming a pivot around which the front segment 30 can rotate and slide. FIG. 18 also illustrates an attachment point 40 used on the projection from the rear segment 30, which is discussed in more detail with reference to FIGS. 11*a* and 11*b* below.

FIG. 9 illustrates how the multiple shell segments 30 may be provided within an actual helmet, in this case an American football helmet. In this example, the front segment 30 extends across the front of the helmet from side to side, to cover the wearer's forehead, and also extends to cover the wearer's crown. The rear shell segment 30 is arranged, in this example, to wrap around from the top of one side, around the back of the head, to the top of the other side. Left and right segments are provided to cover the bottom side portions of the wearer's head (the right segment, from the wearer's perspective, is not visible in FIG. 9, due to the orientation of the helmet).

FIGS. 10A and 10B illustrate further detail with respect to the form of the connectors 20.

FIG. 10A shows a view of an inner shell 3 made up of two shell segments 30, as viewed from the bottom/inside of the shell. That is, there is a front segment 30 comprising a protruding region configured to protrude into a cut-out portion of the rear shell segment. The protruding portion is surrounded on opposing sides by lateral portions of the front shell segment 30 (i.e. the segment 30 comprising the protruding portion), and the protruding portion and the lateral portions are separated by gaps in the front shell segment 30. The inverse arrangement, with the protruding portion being in the rear part of a rear shell segment 30 is also possible. The distal edge of the protruding section can be substantially flat, as shown in FIG. 10A or arced as shown in FIG. 14 for example.

A connector 20 joins the two shell segments 30. Connector 20 in this example includes flange portions 21 which partially overlap with the two shell segments 30. The flange portions 21 act as a layer of material that can be connected to the inner or outer surface of the inner shell 3 to the shell segments 30. The connector 20 further comprises a resilient structure 22 that connects the flange portions 21, and thus spans the space between the shell segments 30.

In the example of FIG. 10A, for the purposes of illustration, the connector 20 comprises parts 20A, 20B, 20C and 20D each having different forms of the resilient structure 22.

For example, part 20A has a resilient structure 22 comprising loops, providing apertures within the resilient structure through the loops and between the points where the edge of the loops meet the flanges 21. The point of contact between adjacent loops also provides angular portions between the shell segments 30. The angle of the angular portions can change, as the shape of the loops are changed by being squashed or stretched, to allow the surrounding shell segments 30 to independently slide with respect to an outer shell 2, by permitting relative movement between the shell segments 30. The adjacent loop structure can also be considered as two intersecting wave structures, with the angle of intersection changing to allow relative movement between the shell segments 30.

In part 20B, the resilient structure 22 comprises a series of substantially rectangular apertures, with struts or straight portions extending between the flanges 21. As shown, the apertures are not perfect rectangles, with the edges of the apertures being slightly curved. This results in the strut portions narrowing towards the centre of the resilient structure 22. This assists with allowing the struts to bend to allow relative movement between the two shell segments 30.

In part 20C, the resilient member 22 includes some apertures which are triangular rather than quadrilateral. Once again, this results in intersecting struts reaching between the two shell segments 30 (i.e. from one flange 21 to the other). However, in this case, the intersecting parts extend at an angle which again assists with allowing relative movement between the at least two shell segments 30 by allowing bending by changing the angle between the intersecting parts and the surrounding shell segments 30.

In part 20D, the resilient structure 22 is provided by a series of circular or oval apertures. In a manner similar to that of part 20B, this results in intersecting struts between the two shell segments 30, with those intersecting struts narrowing towards the centre of the resilient structure 22. As can be seen from these examples, the particular form of the resilient structure 22 can be any structure which allows relative movement between the at least two shell segments to facilitate the shell segments 30 to slide independently of each other with respect to an outer shell 2. This can be done by providing an angular portion between the at least two shell segments, an inflected portion between the at least two shell segments or intersecting parts between the at least two shell segments.

FIG. 10B shows a cross-section through two adjacent shell segments 30 and a connector 20 connecting the two shell segments 30. It can be seen that the flange 21 is only provided on one side of the shell segment 30, in this example. This is preferably the inner side of the inner shell 3, thereby providing an uninterrupted outer surface to avoid interfering with the sliding interface 4 arranged between the inner shell 3 and the outer shell 2. FIG. 10B also shows one method of attaching the connectors 20 to the shell segments 30, by using some form of pin or bolt 23. However, any means for affixing the connector 20 to the shell segments 30 may be used. This can include other types of mechanical fixing means, or chemical fixing means such as the use of an adhesive or glue.

FIGS. 11A and 11B illustrate how an inner shell 3 composed of segments 30 may be attached within the helmet 1.

FIG. 11A shows a top view of an inner shell 3, which is composed of five shell segments 30, connected by connectors 20. Each shell segment 30 is provided with at least one attachment point 40. Attachment point 40 can be used to provide a sliding attachment to the surface surrounding the outer surface of the inner shell 3. For example, as shown in the cross-sectional view of FIG. 11B, that may be a low friction layer 4 acting as a low friction sliding interface between the inner shell 3 and the outer shell 2. The sliding attachment between the inner shell segments 30 and the layer 4 allows for the shell segments 30 to move relative to each other, as well as to slide independently with respect to the outer shell 2 and the sliding facilitator 4. In the depicted embodiment, the overall inner shell, composed of segments 30, may also slide relative to the outer shell 2 by virtue of sliding between the outer surface of the sliding facilitator 4 and the inner surface of the outer shell 2. However, it will be appreciated that the sliding attachments could be provided directly between the inner shell 3 and outer shell 2. Such shell connectors, connecting the inner shell segments 30 to the outer shell 2, could act as the low friction sliding interface 4, allowing sliding between the inner shell 3 and outer shell 2. In that scenario, each shell segment 30 would preferably be provided with at least one shell connector. Preferably the connections between the inner shell 3 and the outer shell 2 formed by the shell connectors would be maintained during the sliding in response to an impact.

The sliding attachment used at attachment points 40 may be any type of appropriate attachment. For example, the connectors discussed in PCT/EP2017/055591 may be used. Those connectors provide a pocket on one part to be connected, within which a plate of material can slide. The plate of material is attached to the part to be connected through an appropriate means, resulting in the two sides of the connection being slidingly connected. Other methods of attachment could include some form of elastic connection, for example.

In FIG. 11B, the low friction sliding interface is provided by a layer 4 which is continuous between inner shell segments 30. That is, there are no gaps in the low friction sliding layer 4, where there are gaps between the segments 30. However, FIG. 12 shows an alternative construction of a low friction sliding layer 4. The low friction sliding layer 4 of FIG. 12 corresponds to the shape of the inner shell segments 30 of FIG. 10A. That is, in FIG. 12, the sliding layer 4 is split into segments having the corresponding shapes to the inner shell segments 30 of FIG. 10A. This allows the segments of the sliding layer 4 to move with the inner shell segments 30 without any additional resistance from additional sliding layer material between the segments 30, for example.

However, in other scenarios, it may be desirable to take advantage of the possibility of deforming the sliding layer 4 between the shell segments 30. This is illustrated in FIG. 13, in which a continuous low friction sliding layer 4 is provided, spanning the gap between two inner shell segments 30. When the inner shell segments move towards each other, as illustrated by the arrows, the low friction layer between the segments 30 can deform, as shown by the dotted line. In this scenario, the low friction layer 4 can act as the connector 20, without any additional parts. That is, in this example, the low friction layer 4 connects the segments 30 in a way that allows independent sliding of the shell segments 30. The shell segments 30 are connected at an outer surface of the inner shell 3 by a layer of material that also covers the inner shell 3 and forms the low friction sliding interface 4 within the outer shell 2.

FIG. 14 shows an alternative method of providing the connectors 20. In this example, the connectors are co-formed with the individual inner shell segments 30, such that the segments 30 and the connectors 20 are also created together from the same material. As such, the connectors 20 can be areas of relative weakness/lower stiffness compared to the segments 30, and can thus deform to allow relative movement of the shell segments with respect to each other. For example, as shown in FIG. 14, connecting regions 20 can be formed with apertures, e.g. of substantially circular cross-section, passing through them to provide the lower stiffness. The material through which the apertures pass form the resilient structure 22 of the connector 20.

Another alternative is shown in FIG. 15, in which an intermediate shell 50 is provided between the segments 30 of inner shell 3 and the outer shell 2.

In one scenario, intermediate layer 50 could act as a connector for segments of the inner layer 32, with the segments 30 being relatively fixed to intermediate layer 50. The parts of intermediate layer 50 acting as the connectors 20, may be structurally weakened in the same way as illustrated in FIG. 14, for example, but this is not necessary. In this scenario, the low friction sliding interface 4 would be between the intermediate layer 50 and the outer shell 2, and thus between the inner shell 3 and the outer shell 2.

In another scenario, the segments 30 of the inner shell 3 may be able to slide relative to the intermediate shell 50. In that scenario, separate connectors 20 (not shown in FIG. 15) may be provided between the segments of inner shell 50.

FIG. 16 illustrates a type of connector 24 made up of two interlocking pieces. The interlocking connector pieces 24 may be made of elastic and/or flexible material. For example, the segments 30 may be made of a foam material, whilst the connector pieces 24 are made of a more solid, but still flexible, plastic material. That allows one of the pieces 24 to be attached to each of the neighbouring segments 30 (e.g. by any means for affixing, as discussed in connection with the connector 20 of FIG. 10*b*) and then the two pieces 24 to be snapped/clicked together. When the connector pieces 24 are in the interlocked arrangement, they function like the previously discussed connectors 20 to allow relative movement between the two shell segments 30.

The skilled person will understand that description has discussed various aspects with respect to various figures, but that features from one figure may be combined with those from another in any technically compatible way.

The invention claimed is:

1. A helmet comprising:

an outer shell comprising a hard outer layer;

an inner shell lining an inner surface of the outer shell and formed from an energy absorbing material configured to protect against a radial component of an impact to a wearer's head; and a low friction sliding interface between the inner shell and the outer shell configured to facilitate sliding of the inner shell relative to the outer shell in response to an impact to the wearer's head to protect against a tangential component of the impact;

wherein the inner shell comprises a plurality of shell segments each shell segment being configured to slide relative to the outer shell at the sliding interface and each shell segment being configured to slide independently of each other shell segment, the plurality of shell segments comprises a front shell segment and a rear shell segment arranged and configured to cover front and rear parts of the wearer's head respectively, the front shell segment being a single continuous shell segment and the rear shell segment being a single continuous shell segment, and one of the front shell segment or the rear shell segment comprises a protruding portion, the protruding portion being part of the single continuous shell segment constituting the front shell segment or rear shell segment, the other of the front shell segment or the rear shell segment comprises a cut-out portion, with the continuous shell segment constituting the other of the front shell segment or rear shell segment having a shape which defines the cut-out portion, and the protruding portion has an edge which is arced, and the protruding portion protrudes into the cut-out portion such that the protruding portion forms a pivot around which the shell segment having the cut-out portion can rotate.

2. The helmet of claim 1, wherein at least two shell segments of the plurality of shell segments are connected to each other by a connector configured to allow relative movement between the at least two shell segments.

3. The helmet of claim 2, wherein the connector is a separate component to the at least two shell segments.

4. The helmet of claim 2, wherein the connector is arranged between the at least two shell segments.

5. The helmet of claim 2, wherein the connector comprises a resilient structure.

6. The helmet of claim 5, wherein the resilient structure comprises at least one angular portion between the at least two shell segments, an angle of said angular portion being configured to change to allow relative movement between the at least two shell segments, or wherein the resilient structure comprises at least one inflected portion between the at least two shell segments, an inflection amount of said angular portion being configured to change to allow relative movement between the at least two shell segments, or wherein the resilient structure comprises at least one loop portion between the at least two shell segments, the shape of said loop portion being configured to change to allow relative movement between the at least two shell segments, or wherein the resilient structure comprises at least two intersecting parts between the at least two shell segments, an angle at which said at least two intersecting parts intersect being configured to change to allow relative movement between the at least two shell segments or wherein the resilient structure comprises a straight portion between the at least two shell segments, the straight portion being configured to bend to allow relative movement between the at least two shell segments.

7. The helmet of claim 2, wherein the connector includes a layer of material connected at an inner or outer surface of the inner shell to the at least two shell segments and spans a space between the at least two shell segments, optionally wherein the connector is connected at an outer surface of the inner shell and covers the at least two shell segments to form the low friction sliding interface with the outer shell.

8. The helmet of claim 2 wherein the connector is a part of the inner shell co-formed with the at least two shell segments between the at least two shell segments and formed so as to have a lower stiffness than the at least two shell segments so as to allow the at least two shell segments to move relative to each other.

9. The helmet of claim 8, wherein the connector comprises apertures in the energy absorbing material forming the part of the inner shell configured to provide the lower stiffness of the connector compared to the at least two shell segments, wherein the energy absorbing material defining the apertures forms a resilient structure, optionally wherein the apertures are circular in cross-section.

10. The helmet of claim 9, wherein the resilient structure comprises at least one angular portion between the at least two shell segments, an angle of said angular portion being configured to change to allow relative movement between the at least two shell segments, or wherein the resilient structure comprises at least one inflected portion between the at least two shell segments, an inflection amount of said angular portion being configured to change to allow relative movement between the at least two shell segments, or wherein the resilient structure comprises at least one loop portion between the at least two shell segments, the shape of said loop portion being configured to change to allow relative movement between the at least two shell segments, or wherein the resilient structure comprises at least two intersecting parts between the at least two shell segments, an angle at which said at least two intersecting parts intersect being configured to change to allow relative movement between the at least two shell segments or wherein the resilient structure comprises a straight portion between the at least two shell segments, the straight portion being configured to bend to allow relative movement between the at least two shell segments.

11. The helmet of claim 2, wherein the connector comprises two interlocking pieces, one of the interlocking pieces being attached to one of the at least two shell segments, the other interlocking piece being attached to a second of the at least two shell segments.

12. The helmet of claim 1, wherein the protruding portion is surrounded on opposing sides by lateral portions of the one of the front shell segment or rear shell segment comprising the protruding portion wherein the protruding portion and the lateral portions are separated by respective gaps in the one of the front shell segment or rear shell segment comprising the protruding portion.

13. The helmet of claim 1, wherein the edge of the protruding portion that is arced is the distal end.

14. The helmet of claim 1, wherein, when the helmet is in use, the front shell segment is an elongate shell segment extending across the front of the helmet from side to side arranged to cover the wearer's forehead and the rear shell segment is arranged to cover rear, left and right portions of the wearer's head, or the front shell segment is an elongate shell segment extending across the front of the helmet from side to side arranged to cover the wearer's forehead and the rear shell segment is arranged to cover rear, left and right portions and a crown of the wearer's head, or the plurality of shell segments further comprises left and right side shell segments arranged to cover left and right sides the wearer's head respectively.

15. The helmet of claim 1, wherein the plurality of shell segments further comprises a central shell segment arranged and configured to cover a crown of the wearer's head, optionally wherein one of the front shell segment and the rear shell segment surrounds the central shell segment, and/or wherein the central shell segment is oval.

16. The helmet of claim 1, wherein adjacent shell segments of the plurality of shell segments have a complementary shape.

17. The helmet of claim 1, wherein at least two adjacent shell segments of the plurality of shell segments are not directly connected to each other, optionally wherein the at least two adjacent shell segments of the plurality of shell segments are arranged so as to be separated by a distance less than a limit of relative movement between the adjacent shell segments.

18. The helmet of claim 1, wherein the plurality of shell segments is arranged such that a separation distance between adjacent shell segments is smaller than a width of the shell segments.

19. The helmet of claim 1 wherein the plurality of shell segments is arranged such that a separation distance between adjacent shell segments is smaller than a thickness of the shell segments.

20. The helmet of claim 1, wherein at least one shell segment of the plurality of shell segments is connected to the outer shell by a shell connector, the shell connector being configured to allow sliding between the inner and outer shells, optionally wherein at least one shell connector is provided for each shell segment, and/or wherein the at least one shell connector is configured to maintain the connection between the inner shell segments and the outer shell during relative sliding in response to an impact.

* * * * *